US006027248A

United States Patent [19]

Nelson et al.

[11] Patent Number: 6,027,248

[45] **Date of Patent: *Feb. 22, 2000**

[54] REUSABLE LEAKPROOF BOTTOM BAG CLOSURE

[75] Inventors: Peter Nelson, Dundee; Bill Dieter, Portland, both of Oreg.

[73] Assignee: The Bag Connection, Dundee, Oreg.

[ * ] Notice: This patent is subject to a terminal disclaimer.

[21] Appl. No.: 09/256,975

[22] Filed: Feb. 24, 1999

Related U.S. Application Data

[63] Continuation of application No. 08/964,724, Nov. 5, 1997, Pat. No. 5,879,083.

[51] Int. Cl.[7] ..... B65D 33/36

[52] U.S. Cl. ..... 383/67; 383/6; 383/41; 383/67; 383/75; 383/113; 383/116; 383/119

[58] Field of Search ..... 383/67, 41, 113, 383/116, 117, 119, 6, 75

[56] References Cited

U.S. PATENT DOCUMENTS

| | | | |
|---|---|---|---|
| 516,097 | 3/1894 | King et al. | 383/67 X |
| 1,517,160 | 11/1924 | Kane | 383/2 |
| 1,537,956 | 5/1925 | McNally | 383/2 |
| 1,606,107 | 11/1926 | Simms | 383/2 |
| 1,719,455 | 7/1929 | Steckler | 383/2 |
| 2,080,252 | 5/1937 | Cook | 383/2 X |
| 2,601,465 | 6/1952 | Tatom | 383/66 X |
| 2,927,617 | 3/1960 | Kurzrock | 383/2 |
| 3,029,852 | 4/1962 | Taylor | 383/2 |
| 5,879,083 | 3/1999 | Nelson et al. | 383/67 |

*Primary Examiner*—Jes F. Pascua
*Attorney, Agent, or Firm*—Miller Nash LLP

[57] ABSTRACT

A bottom bag closure of the present invention is created from a substantially tubular length of fabric and two sets of connectors. One of a first set of connectors is on a partial seam on a back face of the bag. Another one of the first set of the connectors is on a bottom edge of a front face. Each of the second set of connectors is on the bottom edge of the back face adjacent an unconnected portion of the partial seam. The first set of connectors is connected toward the back face of the bag and the second set of connectors is connected toward the front face of the bag. The present invention also includes a method of creating the above set forth leakproof, reusable bottom bag closure.

13 Claims, 2 Drawing Sheets

REUSABLE LEAKPROOF BOTTOM BAG CLOSURE

This is a continuation U.S. patent application Ser. No. 08/964,724, filed Nov. 5, 1997, now U.S. Pat. No. 5,879,083.

BACKGROUND OF THE INVENTION

The present invention relates to a bottom bag closure that may be used in a reusable leakproof bag.

Recycling is now a way of life for most people. Not only are people accustomed to separating their own garbage at home, but they will do so in public places if recycling receptacles are available. This is particularly true of cans and bottles in public areas such as parks, schools, beaches, and restaurants.

Ironically, most recycling receptacles are lined with single use, non-recyclable bags. Once the receptacle is full, the single use bag full of recyclables is put in a larger "bin" receptacle or set out to be picked up by sanitation engineers. Eventually, the single use bag full of recyclables is sent to a recycling center where the contents are recycled. However, the single use bags are typically thrown away. Because people do not want to touch the dirty (and possibly contaminated) contents of the bag, single use bags remain popular.

Bags that have openings at the bottom can be emptied into larger receptacles without contaminating the mouth of the bag. U.S. Pat. No. 3,827,471 to Gregory et al. and U.S. Pat. No. 3,893,595 to Khanna et al. show bags with bottom openings. However, these bags are complicated to use, expensive to produce, and would be unsuitable to handle the residual liquid that is usually present in discarded bottles and cans.

Fruit picking bags such as those shown in U.S. Pat. No. 3,532,146, U.S. Pat. No. 4,925,071, and U.S. Pat. No. 5,201,446 show bottom bag closures that use at least two side connectors to maintain a fold that forms the bottom of the fruit picking bag. Bags such as those shown in U.S. Pat. Nos. 1,137,303, 1,754,100, 2,421,962, 2,596,974, and 4,299,605 show bottom bag closures that have a clip positioned centrally on the back of the bag and a corresponding clip centrally located on the bottom edge of the bag that, when fastened, maintain a fold that forms the bottom of the bag. Several of these bags require multiple seams, each of which requires extra labor to sew and must be taped or otherwise sealed to prevent leakage. Some of these bags also require large folds that use substantial amounts of extra fabric, require extra flaps, or require extra suspenders that support the fold from the sides. Extra fabric, folds, or flaps can prevent fluids from discharging completing, and clearly, and prevent easy cleaning.

What is needed, then, is a reusable bag with a bottom bag closure that is simple to produce, simple to use, easily cleaned after use, and can accommodate residual liquids without leaking.

BRIEF SUMMARY OF THE INVENTION

A bottom bag closure of the present invention is created from a substantially tubular length of fabric having a front face, a back face, and a bottom edge. Preferably there are two sets of connectors. One of a first set of connectors is on a partial seam on the back face of the bag. Another one of the first set of the connectors is on the bottom edge of the front face. Each of the second set of connectors is on the bottom edge of the back face adjacent an unconnected portion of the partial seam. The first set of connectors is connected toward the back face of the bag and the second set of connectors is connected toward the front face of the bag. This combination forms a generally leakproof, reusable bottom bag closure.

A method for forming the above set forth bottom bag closure includes the step of folding and connecting the bottom edge of the first face to the second face above the bottom edge. The next step is extending outward in opposite directions two sides of the bottom edge of the second face and wrapping the two sides of the bottom edge of the second face toward the first face. Finally, by connecting the two sides of the bottom edge toward the first face, the bottom bag closure is formed.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 2:
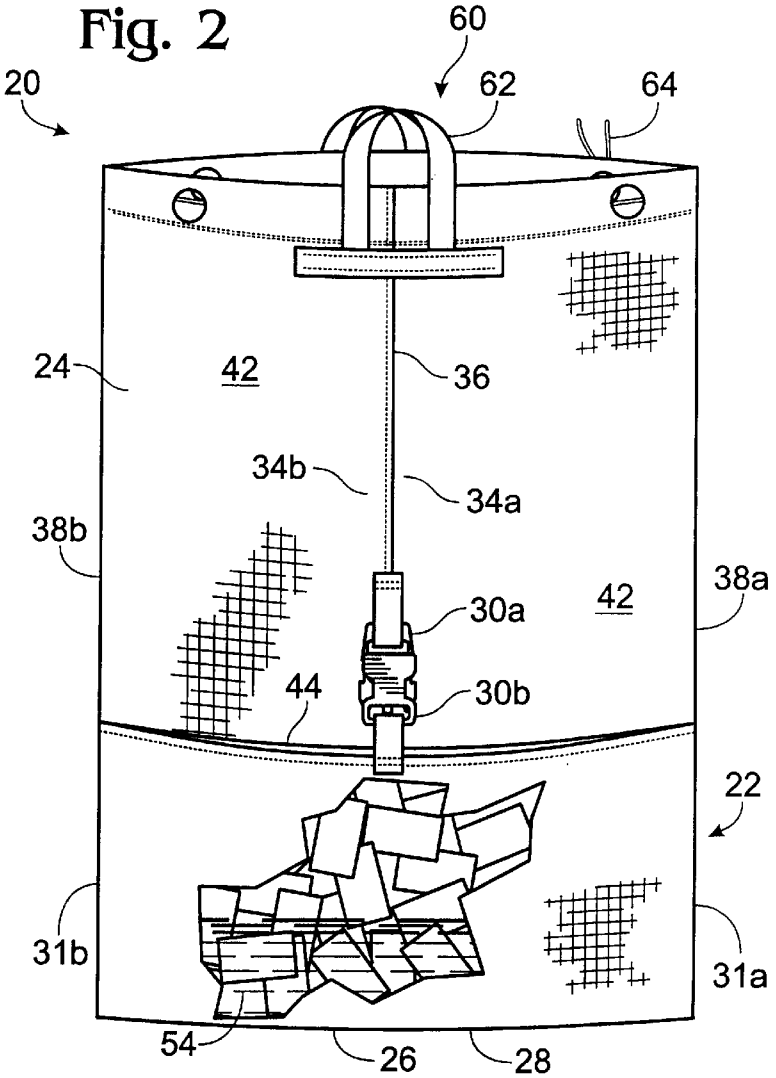
FIG. 2 is a back cutaway view of an exemplary embodiment of the bottom bag closure of the present invention.
Figure 1:
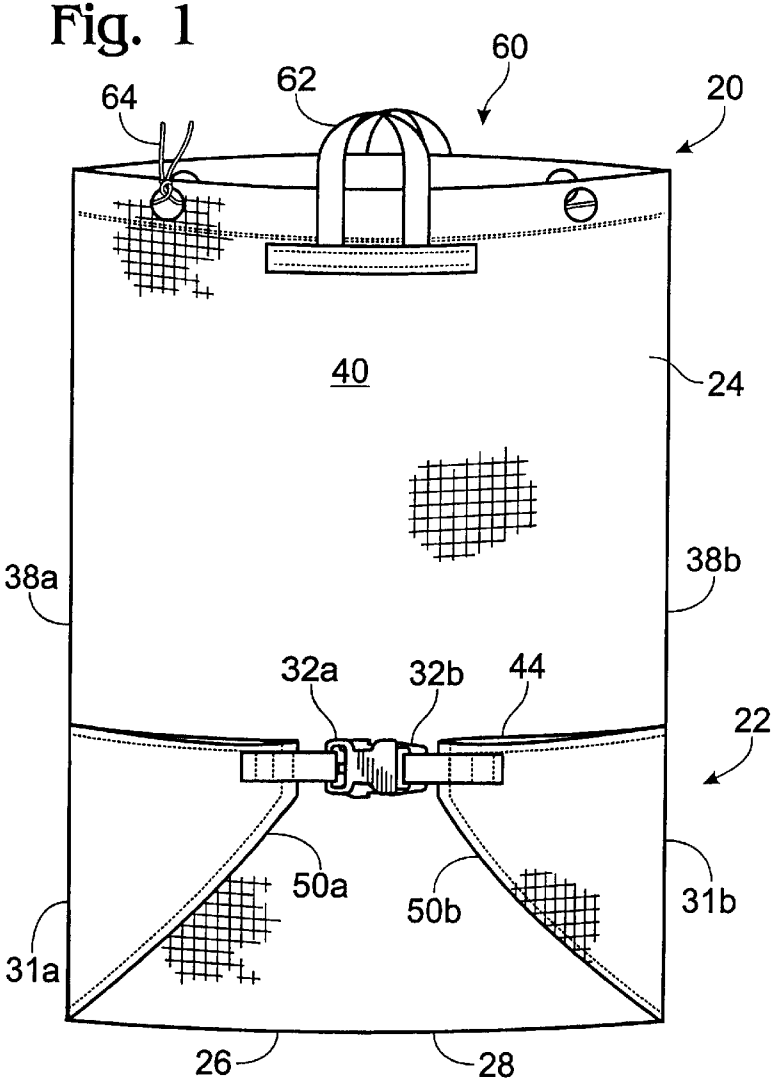
FIG. 1 is a front view of an exemplary embodiment of the bottom bag closure of the present invention.

FIGS. 1 and 2 show an exemplary embodiment of a reusable leakproof bag 20 having a unique bottom bag closure 22. The bottom bag closure 22 is created by folding a substantially tubular length of fabric 24 so that a fold 26 in the fabric forms the bag bottom 28 of the bag 20. The fold 26 is maintained by at least one set of connectors 30*a*, 30*b*. Two vertical or outer side folds 31*a*, 31*b* may be included that are at least partially maintained by a set of connectors 32*a*, 32*b*.

Figure 3B:
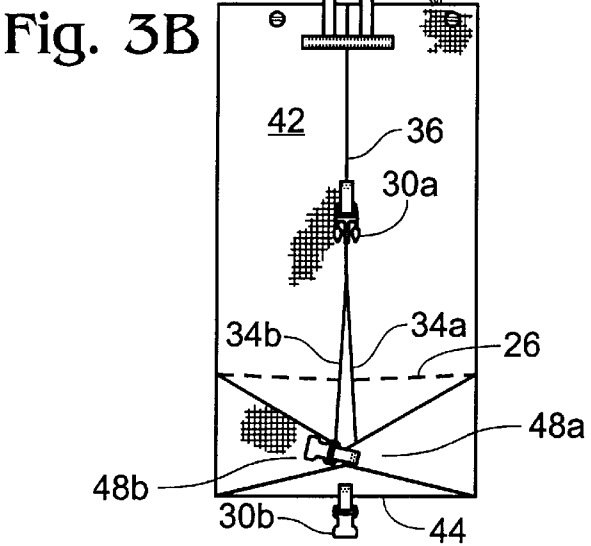
FIGS. 3A–3F depict the series of steps used to construct a bottom bag closure of the present invention.

More specifically, the tubular length of fabric 24 may be formed using a flat length of fabric that has two side edges 34*a*, 34*b* that are at least partially connected by at least a partial seam 36. The partial seam 36 is best seen in FIG. 3B. It should be noted that the tubular fabric 24 may have side folds 38*a*, 38*b* so that the bag 20 can be folded flat. Additional folds may be added so that the bag 20 is expandable or suitable to fit in shaped receptacles.

To aid in the discussion of the invention, once the tubular length of fabric 24 is formed, it has what can be labeled a first or front face 40 and a second or back face 42. The tubular length of fabric 24 also has a bottom edge 44 (FIGS. 3A and 3B). The partial seam 36 is shown on the back face 42 of the bag 20 and is preferably unconnected adjacent and perpendicular to the bottom edge 44.

The first set of connectors 30*a*, 30*b* is preferably used to hold the bottom edge 44 of the bag 20 substantially against the back face 42 of the bag 20 to create the bag bottom 28. Accordingly, one of the first set of connectors 30*a* is on the partial seam 36 on the back face 42 and the other of the first set of connectors is on the bottom edge 44 of the front face 40. The second set of connectors 32*a*, 32*b* is used to hold outer side folds 31*a*, 31*b* that together primarily provide a seamless means of holding residual liquid. Each of the second set of connectors 32*a*, 32*b* are positioned substantially on the corners 48*a*, 48*b* formed by the bottom edge 44 of the back face 42 and the unconnected portion of the partial seam 36 (which also can be thought of as the side edges 34*a*, 34*b*). Optional diagonal seams 50*a*, 50*b* may be provided, however, a preferred simpler embodiment of the bag 20 would use only diagonal folds.

Figure 3C:
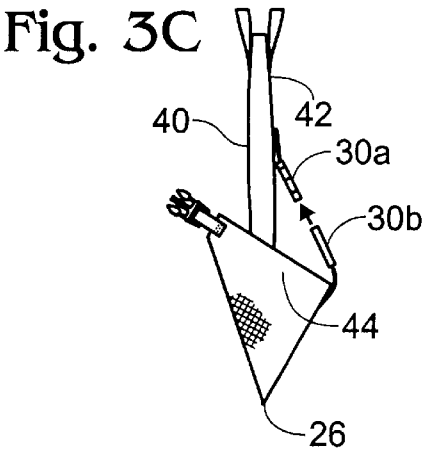
Figure 3A:
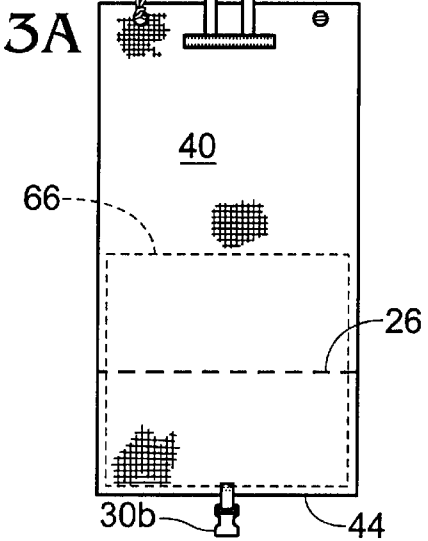
Figure 3E:
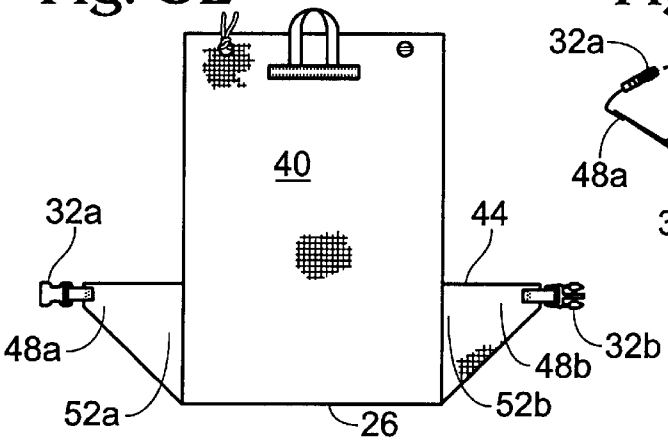
Figure 3F:
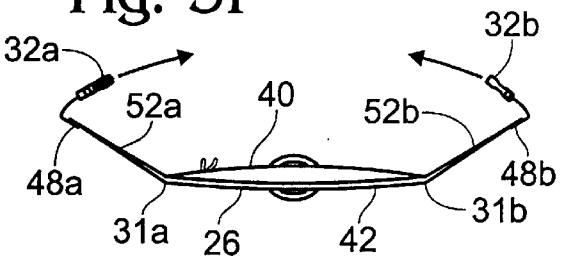
Figure 3D:
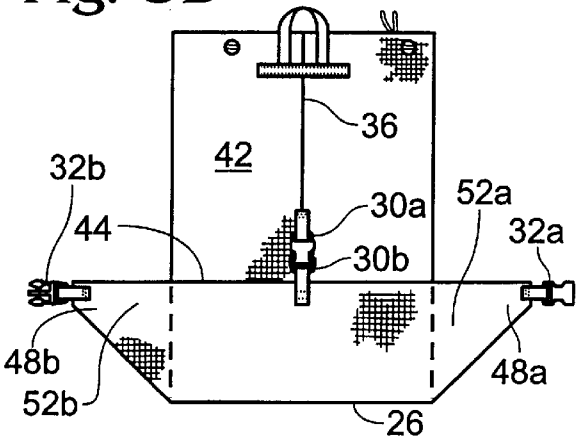

As shown in FIGS. 3A–3F, to form the bottom bag closure 22, the first set of connectors 30*a*, 30*b* are connected toward the back face 42 of the bag 20 and the second set of connectors 32*a*, 32*b* are connected toward the front face 40 of the bag 20. More specifically, FIG. 3A shows the front face of an unfolded bag 20 and FIG. 3B shows the back face of an unfolded bag 20. FIG. 3C shows the step of folding the bottom edge 44 of the tubular length of fabric 24 toward the back face 42. FIG. 3D shows the step of connecting the connector 30*b* on the bottom edge 44 of the front face 40 to the connector 30a on the back face 42 above the bottom edge 44. FIGS. 3D and 3E show the step of extending outward in opposite directions the connectors 32*a*, 32*b* on the two sides 52*a*, 52*b* of the bottom edge 44 of the back face 42. FIG. 3F shows the step of wrapping the two sides 52*a*, 52*b* of the bottom edge 44 of the back face 42 toward the front face 40. FIGS. 1 and 2 show the completely folded bag 20 after the step of connecting the two sides 52*a*, 52*b* of the bottom edge 44 toward the front face 40.

One of the advantages of the bag 20 of the present invention is that the bag 20 can be emptied without the contents being touched. To do this, the connectors 30*a*, 30*b*, 32*a*, 32*b* are unconnected. This allows the fold 26 to be released so that the contents 54 of the bag 20 are pulled by gravity out of the bag 20.

The top 60 of the bag 20, as shown, has handles 62 and a draw string 64. However, alternative bag tops 60 could be used. For example, the top 60 of the bag 20 could have a simple open mouth opening that could be folded over the top of a standard garbage can during use and closed by gathering the mouth and twisting a wire twister around the gathered mouth. Another example would be a top 60 with a 6"–8"diameter cut out of the fabric.

Preferably the fabric 24 is a flexible, reusable, puncture-resistant, waterproof fabric such as coated polyethylene. Some other exemplary fabrics are Sea-Tarp vinyl tarping, 14.5 oz FR Laminate, or Bond-Cote material. However, it is to be understood that other fabrics such as plastic, plastic coated fabrics, waxed fabric, PVC, rubberized fabric, or silicone treated fabrics could also be used. Further, if the bags were to be used for purposes in which they did not need to be waterproof, the choice of fabrics could be extended to non-waterproof fabrics.

The connectors 30*a*, 30*b*, 32*a*, 32*b* are shown as plastic side-release buckles. National Molding Corporation of Farmingdale, N.Y. produces several models that may be used including, but not limited to the Mojave Side Squeeze Buckle, the Stealth Side Squeeze Buckle, the Dual Adjustable Stealth Side Squeeze Buckle, or the Streamline Side Squeeze Buckle. Alternatively, other connectors such as hooks, snaps, buttons, hook and loop fabric (commonly known as VELCRO), or cords may be used.

The bag 20 may have reinforcement in the faces, sides, corners, or bottom. This reinforcement would prevent sharp edges of bottles or other trash from puncturing the bag 20. For example, a second fabric bottom 66 (FIG. 3A) could also ensure fluid retention irrespective of abrasion or delamination of the outer fabric layer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A reusable substantially leakproof bag, comprising:

(a) a substantially tubular length of fabric having a bottom edge;

(b) a horizontal fold in said fabric forming a bag bottom of said bag;

(c) two vertical folds in said fabric forming at least part of two sides of said bag;

(d) at least one first set of connectors, at least one connector of said at least one first set of connectors positioned substantially adjacent said bottom edge, at least one connector of said at least one first set of connectors positioned remote from said bottom edge, said remotely positioned and said substantially adjacent positioned connectors interconnectable for maintaining said horizontal fold;

(e) at least one second set of connectors positioned substantially adjacent said bottom edge, said at least one second set of connectors interconnectable for maintaining said two vertical folds; and (f) wherein said bag bottom is suitable for holding contents of said bag.

2. The reusable leakproof bag of claim 1 wherein said bag has a top with handles.

3. The reusable leakproof bag of claim 1 wherein said bag has a top with a draw string.

4. The reusable leakproof bag of claim 1 wherein said fabric is reinforced.

5. The reusable leakproof bag of claim 1 wherein said fabric is flexible.

6. The reusable leakproof bag of claim 1 wherein said fabric is puncture-resistant.

7. The reusable leakproof bag of claim 1 wherein said fabric is waterproof.

8. The reusable leakproof bag of claim 1 wherein said fabric is coated polyethylene.

9. The reusable leakproof bag of claim 1 wherein said connectors are side-release buckles.

10. A reusable substantially leakproof bag, comprising:

(a) a substantially tubular length of fabric having a bottom edge;

(b) a horizontal fold in said fabric forming a bag bottom of said bag;

(c) two vertical folds in said fabric forming at least part of two sides of said bag bottom;

(d) at least one first set of connectors, at least one connector of said at least one first set of connectors positioned substantially adjacent said bottom edge, at least one connector of said at least one first set of connectors positioned remote from said bottom edge, said remotely positioned and said substantially adjacent positioned connectors interconnectable for maintaining said horizontal fold;

(e) at least one second set of connectors positioned substantially adjacent said bottom edge, said at least one second set of connectors interconnectable for maintaining said two vertical folds; and (f) wherein said bag bottom is suitable for holding contents of said bag.

11. A method of forming a substantially leakproof bag, said method comprising the steps of:

(a) creating a horizontal bag bottom fold in a substantially tubular length of fabric;

(b) securing said horizontal bag bottom fold using a first set of connectors;

(c) creating two vertical bag bottom folds in said substantially tubular length of fabric; and (d) securing said vertical bag bottom folds using a second set of connectors.

12. The method of claim 11, said step of creating a horizontal bag bottom fold forming a bag bottom of said leakproof bag.

13. The method of claim 12, said step of creating two vertical bag bottom folds forming at least part of two sides of said bag bottom of said leakproof bag.

* * * * *